US007337758B2

(12) United States Patent
Sturdy et al.

(10) Patent No.: US 7,337,758 B2
(45) **Date of Patent: *Mar. 4, 2008**

(54) CHARGE MOTION CONTROL VALVE ACTUATOR

(75) Inventors: David R. Sturdy, Wilmington, NC (US); Ronald L. Marsh, Wilmington, NC (US); James D. Gallaher, Leland, NC (US); Paul F. Olhoeft, Wilmington, NC (US)

(73) Assignee: Sturdy Corporation, Wilmington, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/163,495

(22) Filed: Oct. 20, 2005

(65) Prior Publication Data

US 2006/0081208 A1 Apr. 20, 2006

Related U.S. Application Data

(63) Continuation-in-part of application No. 10/907,226, filed on Mar. 24, 2005, now Pat. No. 7,111,602.

(60) Provisional application No. 60/620,299, filed on Oct. 20, 2004.

(51) Int. Cl.
*F02M 35/10* (2006.01)

(52) U.S. Cl. ..... 123/184.53; 123/184.55

(58) Field of Classification Search ..... 123/184.21, 123/184.53, 336, 337, 184.55
See application file for complete search history.

(56) References Cited

U.S. PATENT DOCUMENTS 4,087,728 A 5/1978 Porter
4,246,526 A 1/1981 Phillips
4,570,590 A 2/1986 Kawai et al.
4,645,992 A 2/1987 Ritenour
4,738,233 A 4/1988 Hitomi et al.
4,765,286 A 8/1988 Lyjak
4,816,987 A 3/1989 Brooks et al.
5,092,298 A 3/1992 Suzuki et al.
5,113,826 A 5/1992 Anzai
5,123,382 A 6/1992 Aoki et al.
5,129,368 A 7/1992 Kristl et al.
5,168,954 A 12/1992 Nakaniwa et al.
5,197,433 A 3/1993 Dykstra et al.
5,370,094 A 12/1994 Sorg et al.
5,411,239 A 5/1995 Sorensen
5,590,628 A 1/1997 Patyi et al.
5,632,239 A 5/1997 Patyi et al.
5,704,328 A 1/1998 Dykstra et al.

(Continued)

*Primary Examiner*—Stephen K. Cronin
*Assistant Examiner*—Hyder Ali
(74) *Attorney, Agent, or Firm*—Reising, Ethington, Barnes, Kisselle, P.C.

(57) ABSTRACT

A charge motion control valve actuator method and apparatus that utilizes a motor, output shaft, control circuit, and sensor to provide closed loop control of the position of the output shaft via the motor. The control circuit has an input for receiving actuator commands and has an output connected to the motor to control operation of the motor. The sensor is connected to the control circuit and provides the control circuit with data indicative of the position of the output shaft. The output shaft is connected to the motor via a gear set and coil spring. Feedback from the sensor enables the control circuit to control the position of the output shaft, and the control circuit can also output data relating to the position of the output shaft.

19 Claims, 4 Drawing Sheets

U.S. PATENT DOCUMENTS

| | | | | |
|---|---|---|---|---|
| 5,740,778 | A | 4/1998 | Corcoran et al. | |
| 5,854,545 | A | 12/1998 | Eibel | |
| 5,992,370 | A | 11/1999 | Pringle et al. | |
| 6,051,948 | A | 4/2000 | Vepy | |
| 6,188,193 | B1 | 2/2001 | Michelson | |
| 6,260,528 | B1 | 7/2001 | Pringle et al. | |
| 6,276,316 | B1 | 8/2001 | Arai et al. | |
| 6,281,649 | B1 | 8/2001 | Ouellette et al. | |
| 6,291,955 | B1 | 9/2001 | Itabashi et al. | |
| 6,329,777 | B1 | 12/2001 | Itabashi et al. | |
| 6,386,178 | B1 | 5/2002 | Rauch | |
| 6,422,201 | B1 | 7/2002 | Yamada et al. | |
| 6,637,397 | B2 | 10/2003 | Ward et al. | |
| 6,683,429 | B2 | 1/2004 | Pringle et al. | |
| 6,802,292 | B2 | 10/2004 | Nelson et al. | |
| 6,827,054 | B2 | 12/2004 | Bucknell et al. | |
| 7,111,602 | B2 * | 9/2006 | Sturdy et al. | 123/184.53 |
| 2002/0083911 | A1 | 7/2002 | Ward et al. | |
| 2003/0182049 | A1 | 9/2003 | Bale et al. | |
| 2003/0183202 | A1 | 10/2003 | Mischker et al. | |
| 2004/0035383 | A1 | 2/2004 | Ward et al. | |
| 2004/0099235 | A1 | 5/2004 | Nelson et al. | |
| 2004/0107934 | A1 | 6/2004 | Bucknell et al. | |
| 2005/0211215 | A1 | 9/2005 | Sturdy | |

* cited by examiner

CHARGE MOTION CONTROL VALVE ACTUATOR

CROSS-REFERENCE TO RELATED APPLICATIONS

This application is a continuation-in-part of U.S. application Ser. No. 10/907,226, filed Mar. 24, 2005 which claims the priority of U.S. Provisional Application No. 60/556,122, filed Mar. 25, 2004. This application also claims the priority of U.S. Provisional Application No. 60/620,299, filed Oct. 20, 2004, the entire contents of which are hereby incorporated by reference.

TECHNICAL FIELD

This invention relates to charge motion control valve (CMCV) actuators for regulating the positions of valves within intake manifold ports and control circuits therefore.

BACKGROUND OF THE INVENTION

In 1970, Congress passed the Clean Air Act and established the Environmental Protection Agency (EPA) which initiated a series of graduated emission standards and requirements for maintenance of vehicles over extended periods of time. In the beginning there were few standards, however, in 1988, the Society of Automotive Engineers (SAE) developed a set of diagnostic test signals, and the EPA adapted most of the SAE standards for On-Board Diagnostic programs and recommendations (OBD). Currently, the second generation of these diagnostic standards (OBD-II) has been adopted by the EPA and, as such, internal combustion engine vehicles must now meet the federally mandated OBD-II standards for the life of the vehicle.

A main focus of the EPA in regard to internal combustion engines is on the emissions of the engines. To meet the current federally mandated emission standards prescribed by OBD-II, an internal combustion engine requires management of air flow through an intake manifold. In addition, regulatory requirements mandate that the components used to ensure compliance of the emission standards be continuously monitored over the life of the vehicle. This is in an effort to ensure that the emissions performance over the useful life of the vehicle is not degraded due to a component failure. Generally, actuators used to control the air flow through an intake manifold (herein referred to as CMCV actuators) have been constructed as two position actuators, having a fully open position and a fully closed position. In addition, the actuators generally do not provide position feedback capability to indicate which position the actuator is in. The two position actuators are limited in their ability to regulate the air flow through the intake manifold, and thus, restrict the ability of the engine to operate at its a maximum performance level, and further, limit the ability of the engine to meet emissions, and fuel economy goals.

The OBD-II regulations require that the presence and functionality of emission systems components be monitored. Generally, the monitoring function may be performed using one or more external sensors connected to the vehicle engine controller. This approach adds to the complexity of the emission system assembly, for example by adding additional components and wire connections. In addition, the added external components increase the amount of communication and analysis burden on the engine controller. Though the current OBD-II emission control system requirements come at an increased cost, the manufacturer has little option but to take on these expenses, as a result of having to meet the federally mandated standards.

SUMMARY OF THE INVENTION

The present invention provides a valve actuator method and apparatus for a charge motion control valve or other intake manifold valve. In accordance with one aspect of the invention, the valve actuator comprises a motor, output shaft, control circuit, and sensor. The output shaft is coupled to the motor and is adjustable to different positions by the motor. The control circuit has an input for receiving actuator commands and has an output connected to the motor to control operation of the motor. The sensor is connected to the control circuit and provides the control circuit with data indicative of the position of the output shaft. The control circuit operates the motor in response to the actuator commands to move the output shaft to a commanded position. The control circuit receives feedback signals from the sensor relating to the position of the output shaft. Preferably, the control circuit provides output data relating to the position of the output shaft. The control circuit can also use feedback signals to provide closed loop control of the position of the output shaft.

In accordance with another aspect of the invention, there is provided a valve actuator comprising a motor having a drive shaft, a set of driven components operably connected to the drive shaft, an output shaft driven to various positions by the motor via the driven components, a control circuit having an input for receiving actuator commands and having an output connected to the motor to control operation of the motor, and a stop member located adjacent one of the driven components such that the stop member engages that driven component at a predetermined position and prevents further rotation of that driven component past the predetermined position.

In accordance with yet another aspect of the invention, there is provided a method of operating an actuator for a charge motion control valve of the type having a park position representing a desired end of travel of the valve and having a stop member that stops movement of the valve at a stop position located beyond the park position, the actuator has a motor with a drive shaft connected to an output shaft via a set of gears, the output shaft being rotationally adjustable by the motor to a number of different positions within a normal range of operation including a first target position that corresponds to the park position of the valve. The method includes the steps of (1) energizing the motor to rotate the output shaft in one direction past the first target position to a second target position that is located beyond the stop position and outside of the normal range of operation, (2) outputting position data indicative of the position of the output shaft, and thereafter, (3) energizing the motor to rotate the output shaft in the opposite direction to return the output shaft to a selected position within the normal range of operation.

DETAILED DESCRIPTION OF THE PREFERRED EMBODIMENTS

Figure 1:
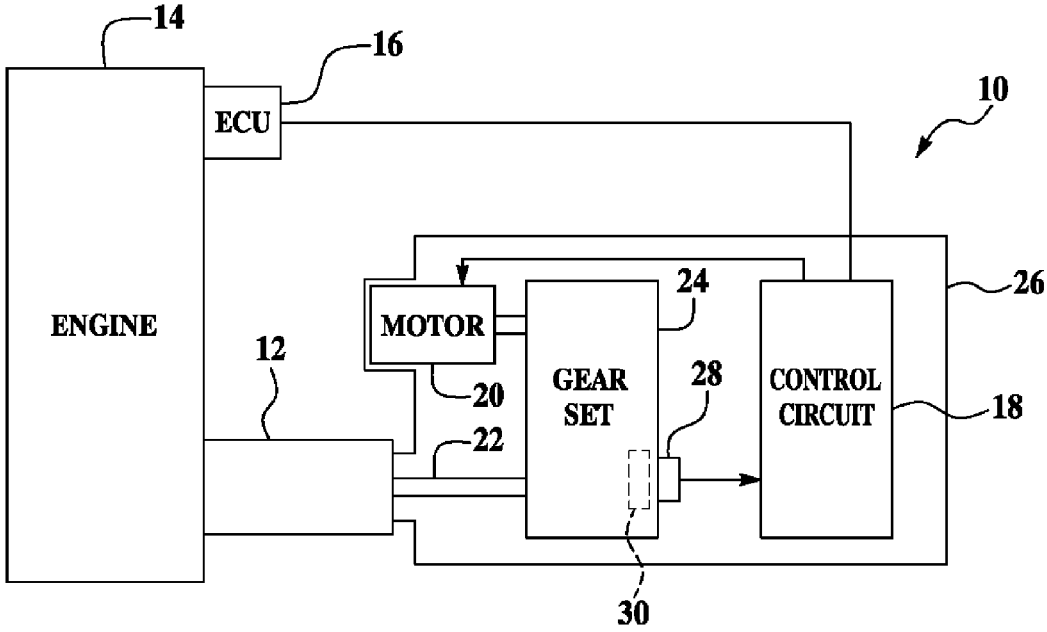
FIG. 1 is a diagrammatic view of a CMCV actuator constructed in accordance with the invention and shown installed in an intake manifold of a vehicle internal combustion engine.

As illustrated in FIG. 1, a CMCV actuator represented generally at 10 is in operable communication with an intake manifold 12 of an internal combustion engine 14 to regulate the air flow through the intake manifold 12 and optimize the running performance of the engine 14. CMCV actuator 10 is connected to an engine control unit (ECU) 16 that is programmed to control actuator 10 to provide the engine 14 with a more optimal flow of air, thus enabling the engine 14 to burn fuel efficiently with reduced emissions.

In general, CMCV actuator 10 is a single, self contained module that includes a control circuit 18 which operates a motor 20 connected to an output shaft 22 via a gear set 24, all of which are mounted in a housing 26. The output shaft 22 extends out of housing 26 for operable communication with the intake manifold 12 to regulate the airflow through individual ports (not shown) within the intake manifold 12. As will be explained in further detail below, ECU 16 delivers actuator commands to control circuit 18 which responds to these command signals by energizing the motor 20 to rotate the output shaft 22 to the commanded position. A sensor 28, located adjacent a member driven by the gear set 24, and shown here as a carrier 30, detects the instantaneous position of the carrier 30 and, thus, the position of the output shaft 22 and the associated components therewith. The position information from this sensor 28 is fed back to the control circuit 18 which uses this feedback data to provide closed loop control of the angular orientation of the output shaft 22. Control circuit 18 is further operable to return feedback data to the ECU 16 indicating the actual, sensed position of the shaft 22 and its associated components.

Figure 2:
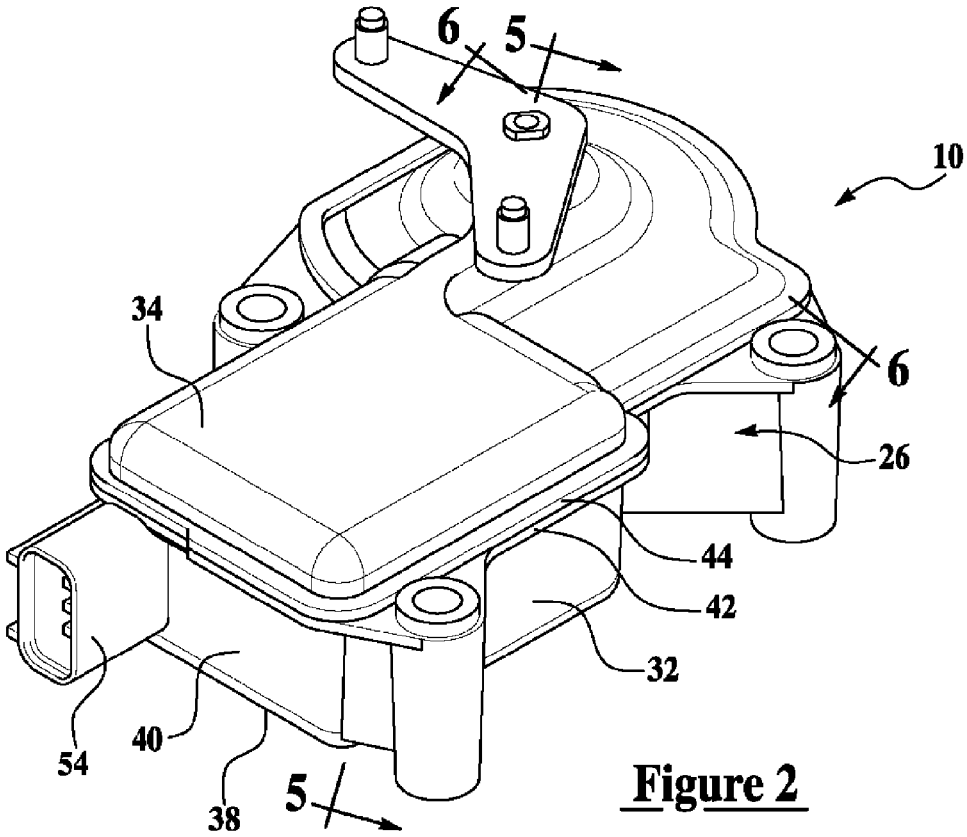
FIG. 2 shows a perspective view of the CMCV actuator of FIG. 1.
Figure 5:
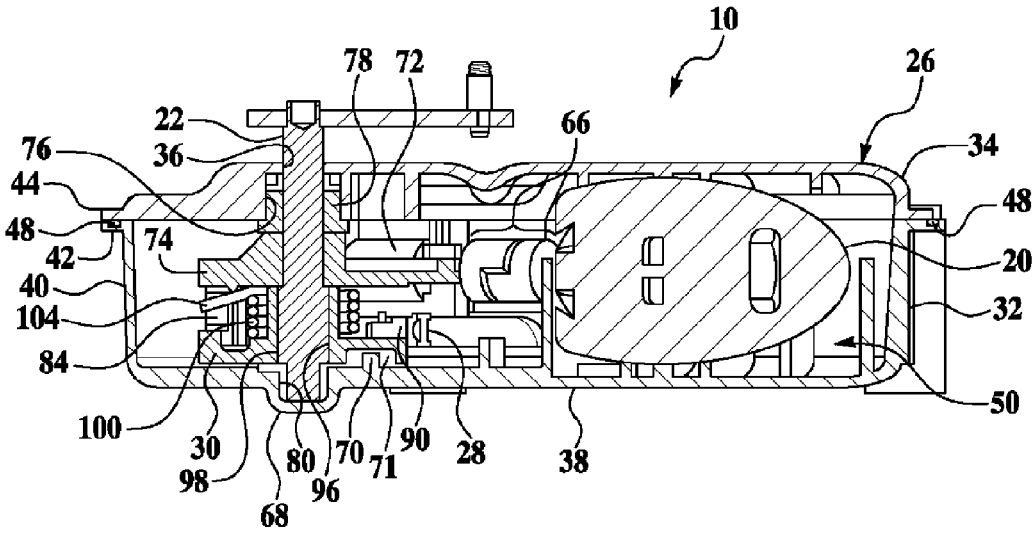
FIG. 5 shows a cross sectional view of the CMCV actuator taken generally along the line 5-5 of FIG. 2.
Figure 6:
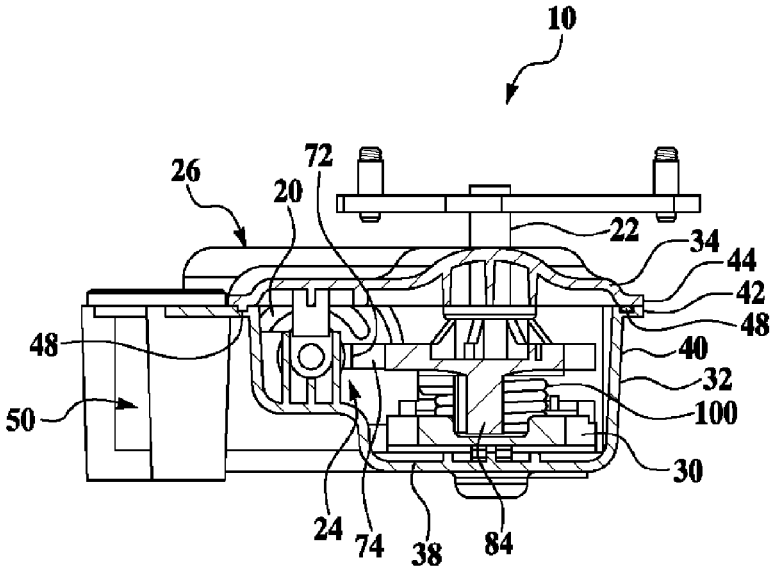
FIG. 6 shows a cross sectional view of the CMCV actuator taken generally along the line 6-6 of FIG. 2.

As shown in FIGS. 2, 5 and 6, housing 26 includes a base 32 and a cover 34. These housing components can be manufactured using known methods and materials such as, for example, molded from a polymer impregnated with nylon or diecast in aluminum or steel. As best shown in FIG. 5, the cover 28 has an opening 36 through which the output shaft 22 extends for operable communication with the associated components external to the housing 24.

The base 32 has a lower wall 38 with a side wall 40 extending generally laterally and upwardly therefrom. The side wall 40 terminates at an outer perimeter defining a lateral flange 42 extending from the side wall 40 constructed for mating engagement with a flange 44 of the cover 34. Desirably, the flange 42 of the base 32 has a peripheral groove 46 (FIG. 4) extending therein for receipt of a seal 48 to facilitate an airtight sealing engagement of the base 32 with the cover 34 upon assembly. It should be recognized that the flange 44 of the cover 34 may also incorporate a groove to receive the seal 48.

As shown in FIGS. 3-6, the side wall 40 and lower wall 38 define a cavity 50 for receiving at least in part the gear set 24 interconnecting a drive shaft 52 of motor 20 with the output shaft 22. The side wall 40 has an integral electrical plug 54 (FIGS. 2-4) extending laterally therefrom for receiving an electrical socket connected via a wiring harness to the ECU 16. The terminals of electrical plug 54 are wired to a printed circuit board (PCB) 56 carrying control circuit 18. To facilitate mounting the motor 20 within the cavity 50, preferably a motor cradle 58 sized for receipt of the motor 20 is integrally formed as part of the base 32. Desirably, the cradle 58 has a pair of arcuate recesses 60, 61 sized for receipt of a pair of reduced diameter nose portions 62, 63 through one of which the drive shaft 52 of the motor 20 extends for operable attachment via a coupler 66 to a driven shaft 64. The coupler 66 allows the drive shaft 52 and the driven shaft 64 to be slightly inclined or axially misaligned relative to one another in operation without having negative consequences to the operation of the assembly 10. The lower wall 38 has a bearing housing 68 extending laterally therein. The bearing housing 68 is arranged for concentric alignment with the opening 36 in the cover 34 upon assembly of the cover 34 to the base 32.

The gear set 24 comprises a drive gear 72, represented here as a worm gear coupled to driven shaft 64 and a driven gear 74, represented here as a segment gear supported for rotation by the output shaft 22. It should be understood that the gear set 24 may be configured differently by using a variety of differently sized or type gears and having differing numbers of gear teeth in order to meet the specific application requirements, such as load constraints, drive motion, and packaging constraints, for example.

As shown in FIG. 5, the opening 36 in the cover 34 has a recess or housing 76 for receiving a bearing 78 to rotatably support the output shaft 22 generally adjacent one end of the shaft, while the other end of the shaft 22 is rotatably supported by a bearing 80 in the bearing housing 68 of base 32. Accordingly, the shaft 22 is supported at generally opposite ends for rotation by the pair of bearings 78, 80.

The segment gear 74 is rotatably received on the output shaft 22 for relative rotation therewith. The segment gear 74 has teeth 82 arranged for meshed engagement with teeth on the worm gear 72. The gear teeth 82 span approximately 120 degrees, although gear 74 is generally driven about 85 degrees in use. To facilitate operable communication between the segment gear 74 and the carrier 30, as discussed hereafter, desirably the segment gear 74 has a tab 84 (FIG. 6) depending generally laterally therefrom towards bottom wall 38.

Figure 4:
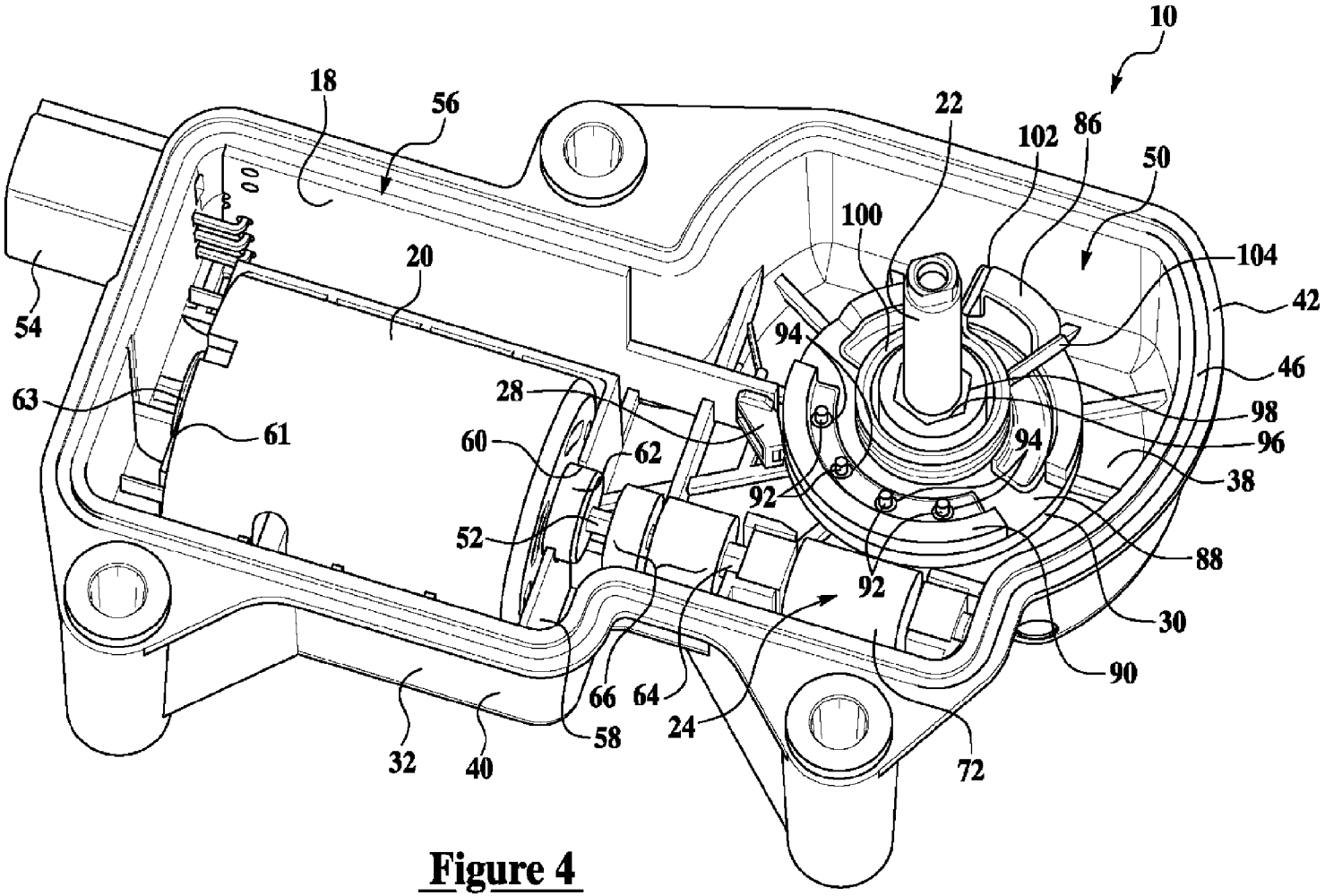
FIG. 4 is a view similar to FIG. 3 taken from a different perspective and showing a segmented gear removed therefrom.

As best shown in FIG. 4, wherein the segment gear 74 is shown removed from the output shaft 22, to facilitate operable communication between the segment gear 74 and the carrier 30, as discussed hereafter, desirably the carrier 30 has a tab 86 appending generally laterally from one of its sides 88 in a direction away from the bottom wall 38. The carrier tab 86 is angularly aligned with, but radially offset from the tab 84 on the segment gear 74 so as to not interfere with the tab 84 during respective movement between the segment gear 74 and the carrier 30. The carrier 30 has a generally arcuate magnet 90 attached on the same upper side 88 as the tab 86, but diametrically opposite therefrom. Magnet 90 is used in conjunction with the position sensor 28, as will be discussed below, and is attached to carrier 30 by a plurality of plastic fingers 92 extending laterally from the side 88 for receipt in through openings 94 in a surface of the magnet 90. The fingers 92 are heat staked to retain the magnet 90 to the side 88 of the carrier 30. Desirably, the magnet 90 is constructed from a magnetized polymeric material, although it should be recognized that any suitable magnetic material may be used. The carrier 30 is fixed for conjoint rotation with the output shaft 22. In one preferred embodiment, the carrier 30 has a non-circular through bore 96, shown here as being hexagonally shaped for mating engagement with a similarly shaped hexagonal portion 98 of the output shaft 22. It should be recognized that any desired mechanism could be used to couple the carrier 30 to the shaft 22, including using fasteners, a weld joint, or adhesives, for example. Otherwise, the carrier could be formed as one piece with the output shaft, if desired.

As best shown in FIG. 4, the segment gear 74 is operatively coupled to the carrier 30 by a coil spring 100. The coil spring 100 is received about the output shaft 22 and has a pair of radially outwardly extending ends 102 and 104 that are in biased engagement with the arc end walls of the tab 86. This can be done using a coil spring 100 that, in its relaxed state, has both ends 102, 104 angularly aligned or nearly so such that the ends 102, 104 must be flexed apart by tightening the coiling of the spring and then snapping the ends over the opposite end walls of tab 86. The tab 84 of the segment gear 74 (shown in FIG. 6) extends downwardly into the space shown in FIG. 4 that is located radially inwardly of tab 86 and that is between the two spring ends 102, 104. The tab 84 spans the same arc as that of tab 86 so that its end walls are also in engagement with the ends 102, 104 of the coil spring 100. Movement of the segment gear 74 in either direction displaces one or the other of the spring ends 102, 104, tightening the spring 100 and thereby driving the carrier tab 84 by way of the force imparted on it by the other spring end. The coil spring 100 is selected having a spring constant as desired for the intended application performance requirements. As the spring constant is increased, the torque applied to the carrier 30 is increased while the response time for the movement of the carrier relative to the movement of the segment gear 74 is decreased.

Figure 3:
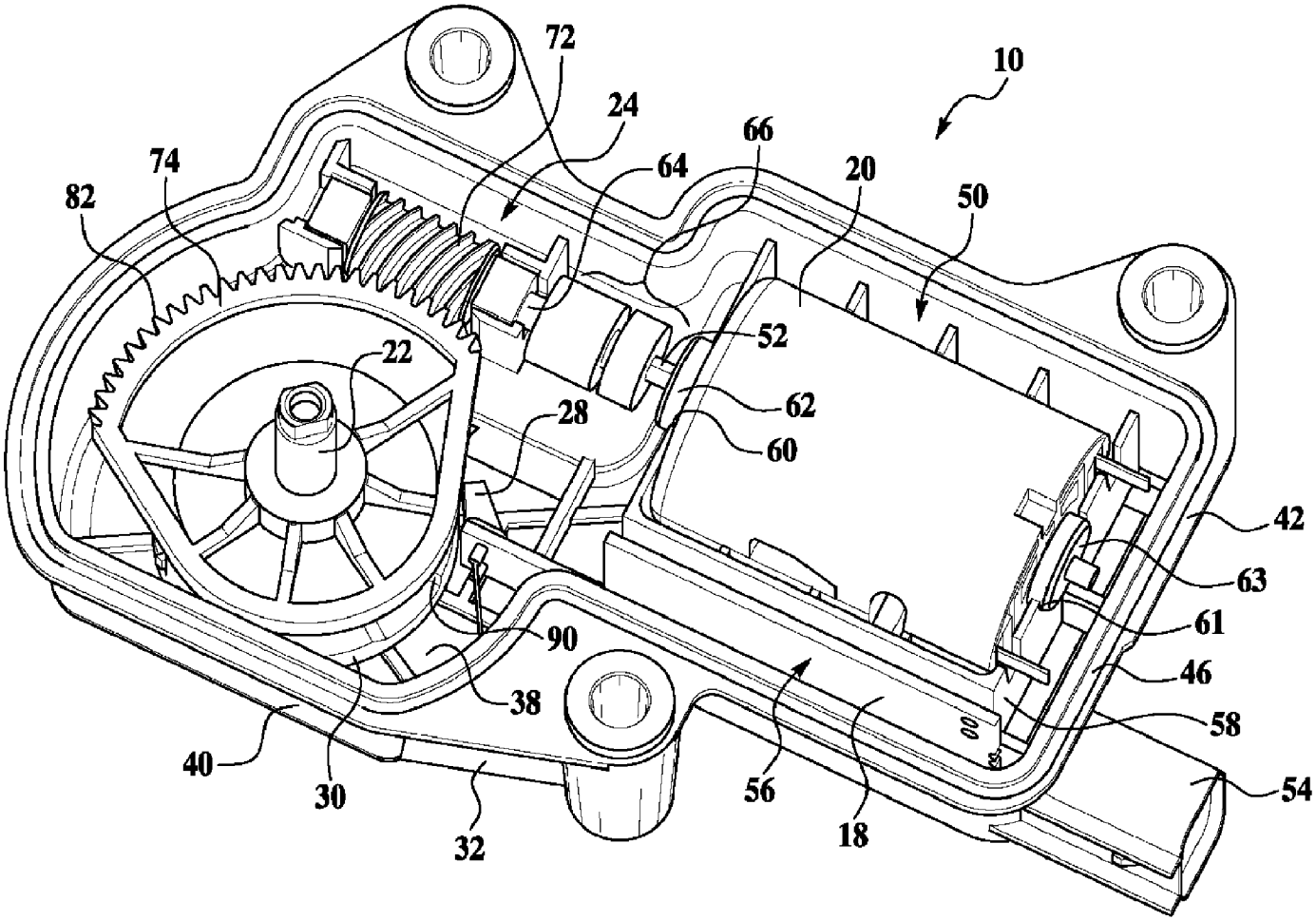
FIG. 3 shows a perspective view of the CMCV of FIG. 1 with a cover removed therefrom.

As shown in FIGS. 3 and 4, the printed circuit board 56 is supported by the lower wall 38 of the base 32. The PCB 56 carries position sensor 28 which can be attached in any suitable manner, such as by heat staking or by soldering of its electrical leads onto terminal pads on the PCB. In the illustrated embodiment, position sensor 28 is a Hall Effect sensor used to determine the position of the carrier 30, and thus, the output shaft 22. This position information is used by the control circuit 18 in achieving the proper output shaft 22 position as well as for reporting back the output shaft 22 position to the ECU 16. Sensor 28 is positioned on PCB 56 so that it is located adjacent the magnet 90 when the PCB 56 and gear set 24 are all assembled in their proper positions within housing 26. As the magnet 90 rotates conjointly with the carrier 30, the magnet 90 rotates relative to the PCB 56, and thus the Hall Effect sensor 28, thereby allowing the Hall Effect sensor 28 to receive a continuously variable magnetic flux from the magnet 90 as it rotates. Accordingly, the Hall Effect sensor 28 generates a signal indicative of this changing magnetic field condition and this signal is used by the control circuit 18 to determine the instantaneous position of the carrier 30, and thus, the position of the output shaft 22 and the components associated therewith.

Control circuit 18 is a microprocessor based control circuit that continuously monitors ECU 16 for commands to rotate the output shaft 22 to a particular angular position. When receiving commands, the control circuit 18 preferably uses a debounce algorithm to insure that a valid position command has been sent by the ECU 16 before activating the motor 20 to initiate movement. Suitable debouncing algorithms are known to those skilled in the art.

To move the output shaft 22, control circuit 18 sends a signal to energize the motor 20, thereby causing the worm gear 72 of the gear set 24 to rotate in one direction and causing the segment gear 74 to rotate toward the commanded angular position. As the segment gear 74 rotates in one direction, the tab 84 engages one of the spring ends 102, 104 (depending on direction), causing that spring end to move conjointly with the segment gear 74, and thereby tending to coil or more tightly wrap the coils of the spring 100. As such, the other spring end engages the tab 86 which moves in response to the torsional force of the coil spring 100, thereby moving the carrier 30 in the same rotational direction as the segment gear 74. As the carrier 30 rotates, the magnet 90 and the output shaft 22 rotate conjointly therewith. Thus, coupler 66, worm gear 72, segment gear 74, coil spring 100, carrier 30, magnet 90, and output shaft 22 are all part of a set of driven components controlled by motor 20 and, although in the illustrated embodiment sensor 28 monitors the position of carrier 30 via magnet 90, the sensor (whether a Hall effect sensor, photo-optic sensor or otherwise) can be coupled with any of these driven components to determine the position of output shaft 22. In this regard, where operation of the output shaft 22 is via a torque-limiting mechanism such as coil spring 100, the sensor can be located on the output shaft side of the coil spring, as in the illustrated embodiment, or can be located on the segment gear side even though movement of the segment gear does not necessarily exactly track movement of the output shaft 22.

Normally, the amount of travel of the segment gear 74 in either direction is limited in software by ECU 16 and/or controller 18. As shown in FIG. 3, over-travel of the gear 74 is further limited by use of a positive stop member 70 which comprises a projection that extends upwardly from bottom wall 38 into an arcuate channel 71 formed in the bottom of carrier 30. The channel 71 is generally semi-circular in shape and limits the travel of the carrier 30 in both directions to approximately 120° by interference of the ends of the channel with the stop member 70. This limits travel of the carrier 30 and thus, the segment gear 74 to prevent over-rotation that could otherwise cause disengagement of the segment gear teeth 82 with the worm gear 72. This travel limit applies to by attempted over-rotation by operation of the motor 20 as well as back-driving the actuator by an external force that rotates the output shaft 22. Further, to prevent potential damage to the motor 20 or the teeth on the gears 72, 74 of the gear set 24, the control circuit 18 monitors the sensor 28 and detects this over-travel condition and can send a signal to the motor 20 to reduce its power output, or stop it altogether. The determination of this over-travel condition by the control circuit 18 can be done in various ways such as by monitoring motor current or detecting absolute position or changes in position of the carrier 30.

As magnet 90 rotates with the carrier 30, the control circuit 18 monitors the flux direction and strength of the magnetic field impinging on the Hall Effect sensor 28. The voltage level of the position feedback signal from the Hall Effect sensor 28 is compared by the control circuit 18 to a voltage range programmed within the control circuit 18 to ensure that the received feedback signal voltage is within a valid range. Upon determining that the voltage level is proper, the actual angular position of the output shaft 22 is determined, which can be done in various ways, such as by using equations or a look-up table, for example. This sensed, actual position can then be compared by the control circuit 18 to the commanded position received from the ECU 16 and the resulting error used to adjust the position of the output shaft 22 until no error exists between the commanded and actual positions, or until the error falls to within an acceptable level. In this way, the control circuit 18 provides closed loop control of the position of output shaft 22, and this is done without involving the ECU 16 and, thus, without any additional computational effort by ECU 16. Other closed loop control schemes can be used in addition to or in lieu of proportional control, including integral and derivative control, and these control approaches can be used not only to achieve the commanded position, but if desired, to also control the speed at which the adjustments are made. For example, for larger angular adjustments, the rotational speed of the output shaft 22 could be increased. Such control schemes are known to those skilled in the art.

Once the output shaft 22 has reached its commanded position, as determined from the position feedback from sensor 28, the control circuit 18 interrupts power to the motor 20. Thereafter, the control circuit 18 will wait for a subsequent actuator command from ECU 16. Additionally, the control circuit 18 will periodically sample the angular position of the output shaft 22. If the output shaft 22 inadvertently moves from its commanded angular position, the control circuit 18 again activates the motor 20 to re-orient the output shaft 22 back to its commanded angular position. In addition to using the position feedback from sensor 28 for closed loop control, the control circuit 18 can also report the actual position back to the ECU 16, thereby providing confirmation of the output shaft 22 position.

The sensor 28 and control circuit 18 can also be used in conjunction with an external stop feature to determine whether the CMCV (not shown) that is being operated by the CMCV actuator 10 is present and functioning properly. In particular, the output shaft 22 can be connected to a linkage mechanism (partially shown in FIGS. 2, 5, and 6) which operates the CMCV. If the linkage mechanism or CMCV itself is equipped with a stop member, the control circuit 18 (or ECU 16) can be programmed to detect the presence and proper functioning of the CMCV by driving the output shaft 22 to the point at which this stop member would normally be engaged. If the rotation of shaft 22 is stopped, this will be detected by control circuit 18 using sensor 28, and the control circuit and/or ECU 16 can then confirm that the CMCV is present and functioning. If the shaft 22 moves past the position corresponding to the stop member, then this indicates a malfunction condition which can be reported and logged. Thus, CMCV actuator 10 can be used to help implement compliance with OBD-II requirements. Either this external stop member or the stop member 70 can also be used to enable re-calibration of absolute position by driving the segment gear or external linkage against the stop and then recording in memory that position as a reference. Other processing of the sensor 28 data and/or motor current data can be done to determine, for example, undue resistance to rotation of the segment gear 74 or output shaft 22.

Where an external stop member is used, CMCV actuator 10 can be programmed to move within a normal range of operation delimited at each end by a first target position. At either end of travel, this first target position corresponds to a desired CMCV "park" position, wherein the CMCV is in either its fully open or fully closed position. During normal use, the CMCV actuator can be commanded to drive its output shaft 22 to either of these positions or to any position in between. The actuator 10 is also programmed with a second target position at each end of travel that represents over-rotation of the valve beyond its park position and beyond the external stop member contained in either the CMCV itself or the linkage mechanism between the CMCV and output shaft 22. To detect that the CMCV is present and operating properly, the actuator 10 can be commanded to this second position in which case it drives the output shaft 22 to the first target position and then moves beyond that position at a reduced speed and torque until it either stops (due to the external stop member) or reaches the second target position. In either case, it returns position information back to the ECU 16 which uses that position information to determine whether it stopped due to the external stop member or whether it over-rotated. In the latter case, the ECU can send a diagnostic error to indicate the CMCV malfunction. The actuator 10 maintains the output shaft at this post-park position long enough for ECU 16 to obtain a position reading and then returns it to the first target (park) position or to some other position within the normal range of operation until further commands from ECU 16 are received. Other approaches for detecting over-travel of the output shaft can be used in addition to or in lieu of this first and second target position approach.

It will thus be apparent that there has been provided in accordance with the present invention a CMCV actuator 10 which achieves the aims and advantages specified herein. It will of course be understood that the foregoing description is of a preferred exemplary embodiment of the invention and that the invention is not limited to the specific embodiment shown. Various changes and modifications will become apparent to those skilled in the art, such as for example, attaching a magnet to the segment gear in addition to or in lieu of the magnet on the carrier, and positioning a sensor adjacent the segment gear to detect the position of the segment gear, and thus, the output shaft. Alternatively, non-magnetic sensors can be used in lieu of the disclosed Hall effect sensor; for example, any of those known in the art that use photo-detection or resistance to determine position. Further, the stop member could be positioned adjacent one of the gears in the gear set to prevent separation or disengagement of the gears from one another. All such variations and modifications are intended to come within the scope of the appended claims.

As used in this specification and claims, the terms "for example" and "such as," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A valve actuator for regulating airflow through an intake manifold of an internal combustion engine based on actuator commands received from an ECU, comprising:

a motor;

an output shaft coupled to said motor, said output shaft being adjustable to different positions by said motor;

a control circuit having an input that receives actuator commands from the ECU and having an output connected to said motor to control operation of said motor; and a sensor connected to said control circuit, said sensor providing said control circuit with data indicative of the position of said output shaft;

wherein said control circuit operates said motor in response to said actuator commands received from the ECU to move said output shaft to a commanded position, and wherein said control circuit receives feedback signals from said sensor relating to the position of said output shaft.

2. A valve actuator as defined in claim 1, wherein said control circuit provides output data relating to the position of said output shaft.

3. A valve actuator as defined in claim 1, wherein said control circuit uses the feedback signals to provide closed loop control of the position of said output shaft without involving the ECU.

4. A valve actuator as defined in claim 1, further comprising a housing, wherein said motor, control circuit, and sensor are mounted in said housing.

5. A charge motion control valve that includes the valve actuator of claim 1.

6. A valve actuator for regulating airflow through an intake manifold of an internal combustion engine, comprising:

a motor;

an output shaft coupled to said motor, said output shaft being adjustable to different positions by said motor;

a control circuit having an input for receiving actuator commands and having an output connected to said motor to control operation of said motor; and a sensor connected to said control circuit, said sensor providing said control circuit with data indicative of the position of said output shaft;

wherein said control circuit operates said motor in response to said actuator commands to move said output shaft to a commanded position, and wherein said control circuit receives feedback signals from said sensor relating to the position of said output shaft; and wherein said motor includes a drive shaft and said actuator includes a gear set connected to said drive shaft, said output shaft being connected to said gear set such that said output shaft can be driven to various positions by said motor via said gear set, and wherein said sensor is positioned adjacent said gear set to detect the rotational position of said drive shaft.

7. A valve actuator as defined in claim 6, wherein said gear set includes a drive gear operably connected to said drive shaft and a driven gear in meshed engagement with said drive gear such that said output shaft can be driven to various positions by said motor via said driven gear, said driven gear being rotatably received on said output shaft such that said driven gear can rotate relative to said output shaft, said valve actuator further comprising a carrier attached to said output shaft for conjoint movement therewith, said carrier being in operable communication with said driven gear to move in response to the movement of said driven gear.

8. A valve actuator as defined in claim 7, wherein said sensor is located adjacent said carrier such that said sensor detects the position of said output shaft by detecting the rotational position of said carrier.

9. A valve actuator as defined in claim 8, wherein said sensor is a Hall effect sensor, and wherein said carrier includes a magnet extending about at least a portion of a periphery of said carrier.

10. A valve actuator as defined in claim 7, wherein said carrier is connected to said driven gear via a coil spring.

11. A valve actuator as defined in claim 10, wherein said coil spring includes two radially-extending ends, and said carrier and said driven gear each include a tab captively positioned between said two ends of said coil spring.

12. A valve actuator for regulating airflow through an intake manifold of an internal combustion engine, comprising:

a motor having a drive shaft;

a set of driven components operably connected to said drive shaft;

an output shaft driven to various positions by said motor via said driven components;

a control circuit having an input for receiving actuator commands and having an output connected to said motor to control operation of said motor; and a stop member located adjacent one of said driven components such that said stop member engages said one driven component at a predetermined position and prevents further rotation of said one driven component past said predetermined position;

wherein said driven components include a driven gear, coil spring, and carrier, said driven gear being mounted on said output shaft and being rotatable relative to said shaft, said coil spring being mounted on said shaft, and said carrier being connected to said output shaft such that said carrier and said output shaft cannot undergo rotation relative to each other, wherein said driven gear and said carrier are connected to ends of said coil spring such that rotation of said driven gear by said motor causes concomitant rotation of said carrier via said coil spring.

13. A valve actuator as defined in claim 12, wherein said stop member engages said carrier at said predetermined position.

14. A valve actuator as defined in claim 12, wherein rotation of said one driven component is limited in each direction by said stop member.

15. A charge motion control valve actuator for controlling the angular position of an output shaft to regulate airflow through an intake manifold of an internal combustion engine, comprising:

a motor having a drive shaft;

a driven shaft attached to said drive shaft by a coupler for conjoint rotation therewith, said coupler allowing said driven shaft to be inclined relative to said drive shaft;

a drive gear connected to said driven shaft;

a driven gear in meshed engagement with said drive gear such that said output shaft can be driven to various positions by said motor via said driven gear, said driven gear being rotatably received on said output shaft such that said driven gear can rotate relative to said output shaft;

a carrier fixed to said output shaft for conjoint movement therewith;

a control circuit having an input for receiving actuator commands and having an output connected to said motor to control operation of said motor;

a sensor connected to said control circuit and being positioned adjacent said carrier to detect the rotational position of said output shaft; and a spring received about said output shaft in engagement with said driven gear and said carrier such that rotational movement of said driven gear is imparted to said carrier via said spring.

16. A method of operating an actuator for a charge motion control valve having a park position representing a desired end of travel of the valve and having a stop member that stops movement of the valve at a stop position located beyond the park position, said actuator having a motor with a drive shaft connected to an output shaft via a set of gears, said output shaft being rotationally adjustable by said motor to a number of different positions within a normal range of operation including a first target position that corresponds to the park position of the valve, said method comprising the steps of:

energizing said motor and rotating said output shaft in one direction past said first target position to a second target position that is located beyond the stop position and outside of said normal range of operation;

outputting position data indicative of the position of said output shaft; and thereafter, energizing said motor and rotating said output shaft in the opposite direction until said output shaft returns to a selected position within said normal range of operation.

17. The method of claim 16, wherein said outputting step further comprises detecting the position of said output shaft using a carrier fixed to said output shaft for conjoint movement therewith.

18. The method of claim 16, further comprising the step of outputting data indicative of a diagnostic trouble code if said output shaft reaches said second target position.

19. The method of claim 16, wherein said energizing steps further comprise rotating said output shaft via a coil spring coupled between said output shaft and said motor.

* * * * *